US007617968B2

(12) United States Patent
Mertz

(10) Patent No.: US 7,617,968 B2
(45) Date of Patent: Nov. 17, 2009

(54) CAN DISPENSER

(75) Inventor: Stephen C. Mertz, 1006 W. Webster, Royal Oak, MI (US) 48073-3331

(73) Assignee: Stephen C. Mertz, Royal Oak, MI (US)

( * ) Notice: Subject to any disclaimer, the term of this patent is extended or adjusted under 35 U.S.C. 154(b) by 0 days.

(21) Appl. No.: 11/226,649

(22) Filed: Sep. 14, 2005

(65) Prior Publication Data

US 2006/0219766 A1 Oct. 5, 2006

Related U.S. Application Data

(60) Provisional application No. 60/666,362, filed on Mar. 30, 2005.

(51) Int. Cl.
*B65D 5/54* (2006.01)

(52) U.S. Cl. ..... 229/104; 206/45.25; 206/762; 229/122; 229/242

(58) Field of Classification Search ..... 229/104, 229/122, 122.1, 242; 206/45.25, 427, 762; 221/302, 305; *B65D 5/54*
See application file for complete search history.

(56) References Cited

U.S. PATENT DOCUMENTS 1,434,165 A * 10/1922 Ten Eyck ..... 206/45.26
2,312,595 A * 3/1943 Smith ..... 206/45.25
2,473,635 A * 6/1949 Buttery ..... 206/45.26
2,532,216 A * 11/1950 Williamson ..... 206/45.25
2,730,232 A * 1/1956 Coe ..... 206/45.26
3,178,242 A * 4/1965 Ellis et al. ..... 229/104
4,030,596 A * 6/1977 Snyder et al. ..... 206/45.26
5,878,947 A * 3/1999 Hoy et al. ..... 229/122.1
6,283,293 B1 9/2001 Lingamfelter ..... 206/427
6,578,736 B2 6/2003 Spivey ..... 221/305
6,604,677 B1 8/2003 Sutherland ..... 229/242
6,715,639 B2 4/2004 Spivey ..... 221/33
6,789,673 B2 9/2004 Lingamfelter ..... 229/164
6,866,185 B2 * 3/2005 Harrelson ..... 229/104
6,902,104 B2 6/2005 Holley, Jr. ..... 229/242
2005/0178687 A1 * 8/2005 Spivey, Sr. ..... 206/427

FOREIGN PATENT DOCUMENTS

GB 2189223 A * 10/1987

* cited by examiner

*Primary Examiner*—Gary E Elkins
(74) *Attorney, Agent, or Firm*—Gifford, Krass, Sprinkle, Anderson & Citkowski, P.C.

(57) ABSTRACT

A dispenser for rectangular cans having a rectangular elongated box dimensioned to hold a plurality of the cans in a side-by-side relationship. The box includes a top panel, bottom panel, first end panel, second end panel, and two side panels. A dispensing opening is formed by perforations through the first end panel to allow a single can to be removed from the box. An elevation member is formed by perforations through the opposite end of the box for elevating the opposite end of the box relative to the first end panel.

2 Claims, 1 Drawing Sheet

CAN DISPENSER

CROSS REFERENCE TO RELATED APPLICATIONS

This application claims benefit from U.S. Provisional patent application Ser. No. 60/666,362, filed Mar. 30, 2005, the entire contents of which is incorporated herewith in its entirety.

BACKGROUND OF THE INVENTION

I. Field of the Invention

The present invention relates generally to can dispensers.

II. Description of Related Art

Many dispensers for cylindrical containers, such as cans of soda pop, beer and the like, typically comprise a rectangular cardboard box. The cardboard box is dimensioned so that a plurality of the cans are contained within the interior of the box in a side-by-side relationship.

In one type of previously known containers, the box is dimensioned to fit inside a refrigerator and to be opened at one end. Typically, perforations are formed through the box which define the dispenser opening. Consequently, when access is desired to the cans of the interior of the box, the box is ripped along the perforations around the dispensing opening. Upon opening, the cans within the interior of the box are removed from the interior of the box through the dispensing opening.

One disadvantage of these previously known boxes, however, is that the last few cans within the interior of the box are oftentimes positioned within the box at its end most spaced from the dispensing opening. Consequently, in order to remove these cans from the interior of the box, it is necessary to reach into the interior of the box through the dispensing opening and to the opposite end in order to reach the last few cans. This is not only inconvenient, but can also result in chafing and even lacerations on the person's arm as the arm is extended into the interior of the box.

SUMMARY OF THE PRESENT INVENTION

The present invention provides a can dispenser which overcomes all of the above-mentioned disadvantages of the previously known dispensers. In brief, the present invention comprises a rectangular elongated box dimensioned to hold a plurality of cylindrical cans in a side-by-side relationship. The box is typically constructed of cardboard and includes a top panel, bottom panel, first end panel, second end panel and two side panels.

A dispensing opening is formed in the first end panel and this dispensing opening is dimensioned to allow single cans to be removed from the interior of the box. The dispensing opening is preferably formed at the first end panel by tearing the box along perforations formed through the box which define the dispensing opening. Consequently, when access to the cans within the box is desired, the box is ripped along the perforations to form the dispensing opening.

An elevation member is also integrally formed as a part of the box at the end of the box opposite from the dispensing opening. In operation, the elevation member elevates the second end of the box relative to the first end panel so that the bottom panel of the box slopes downwardly from the second end panel and to the first end panel. Consequently, the final few cans within the interior of the box will automatically roll through the force of gravity toward the dispensing opening for easy access by the user.

Preferably, perforations are formed through the side panels and second end panel of the box to define three sides of the elevation member. When use of the elevation member is desired, the elevation member is torn along the perforations and pivoted along a line extending transversely across the bottom panel so that the elevation member is positioned underneath the bottom panel.

Consequently, the dispenser of the present invention provides a simple, yet highly effective dispenser for cylindrical cans which overcomes the disadvantages over previously known dispensers.

BRIEF DESCRIPTION OF THE DRAWING

A better understanding of the present invention can be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
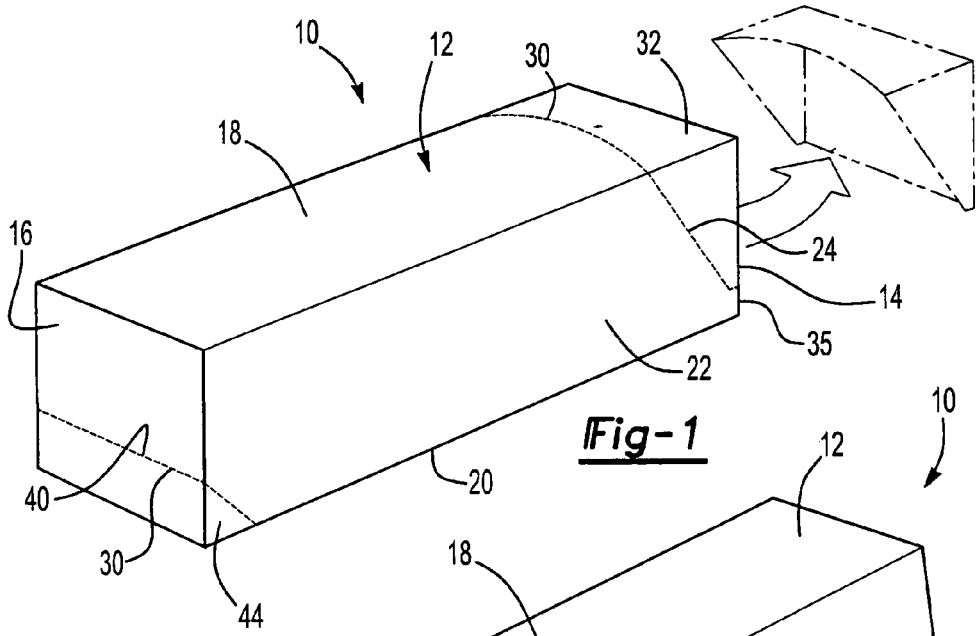
FIG. 1 is an elevational view illustrating a preferred embodiment of the present invention and with the elevation member in a first position.
Figure 2:
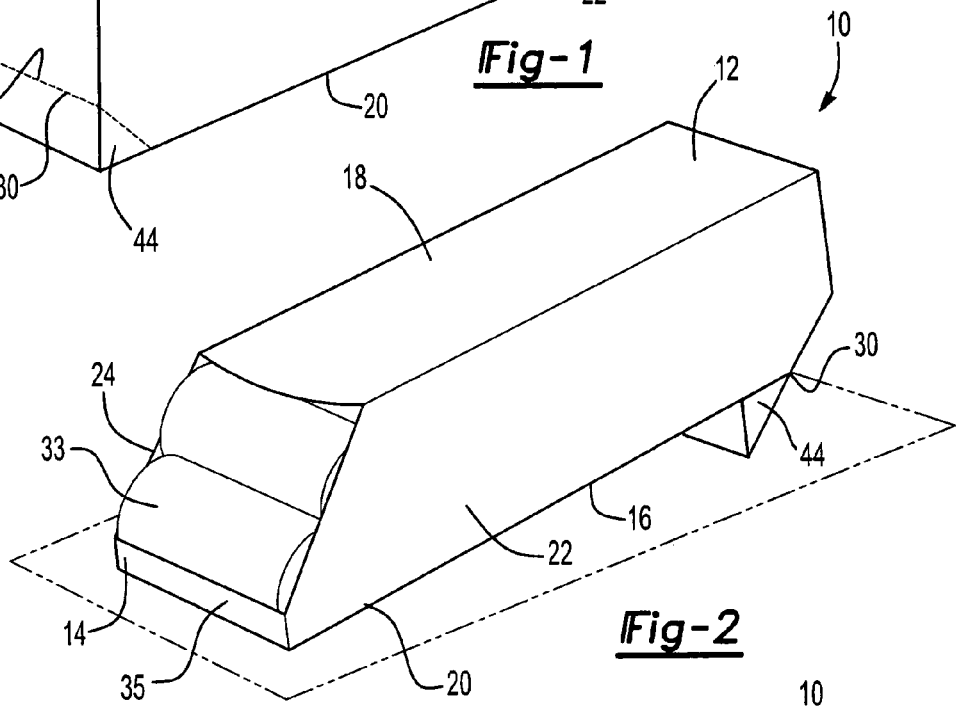
FIG. 2 is a view similar to FIG. 1, but illustrating the elevation member in a second position.
Figure 3:
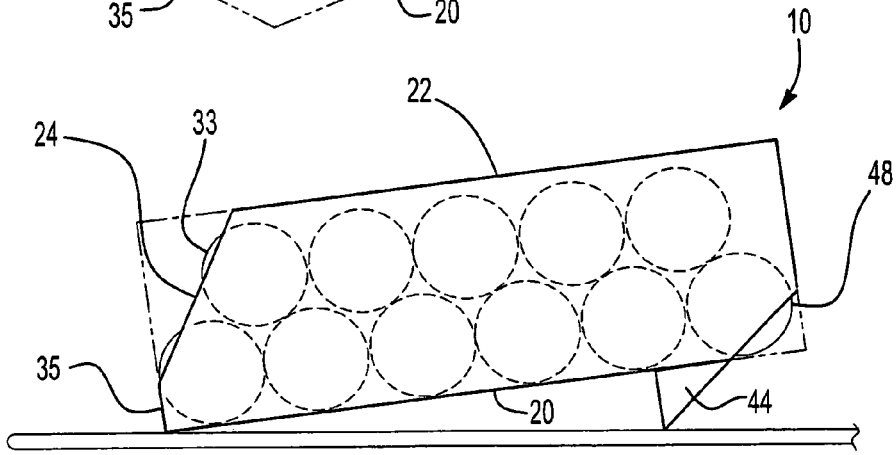
FIG. 3 is a side view of the preferred embodiment of the present invention.

With reference first to FIGS. 1-3, a preferred embodiment of the dispenser 10 of the present invention is shown and comprises a generally rectangular box 12. The box 12 includes a first end panel 14, a second end panel 16, a top panel 18, a bottom panel 20 and two opposed side panels 22. Each of the box panels 14-22 are generally rectangular in shape and preferably constructed of cardboard or similar material.

With reference now particularly to FIGS. 1 and 2, a dispensing opening 24 is formed at one end 26 of the box 12. Preferably, the dispensing opening 24 is formed by perforations 30 (FIG. 1) formed through both side panels 22, the first end panel 14 and the top panel 18. Consequently, when it is desired to remove cans from the interior of the box 12, a closure portion 32 of the box 12 is removed along the perforations 30 as shown in phantom line in FIG. 1 to form the dispensing opening 24. This dispensing opening 24 is sufficiently large to enable cans 33 contained within the interior of the box 12 to be removed from the interior of the box 12.

As best shown in FIG. 2, upon removal of the closure portion 32, a portion 35 of the first end panel 14 protrudes upwardly from the bottom panel 20 and remains attached to the box 12. This portion 35 of the box 12 prevents any cans contained within the interior of the box 12 from freely rolling outward through the dispensing opening 24.

With reference now to FIGS. 1 and 3, a plurality of perforations 40 are also provided through the second end panel 16 of the box 12. These perforations 40 extend through a portion of both side panels 22 and terminate at the bottom panel 20. The perforations 40 define a triangular-shape elevation member 44 that is integrally formed from the box 12 and, prior to use, each side of the elevation member 44 is coplanar with one of the box panels 14-22. When not in use, the elevation member 44 is in a first position, illustrated in FIG. 1.

Consequently, when use of the elevation member is desired, the elevation member 44 is separated from the box 12 along the perforations 40. The elevation member 44 is then pivoted along a transverse line on the bottom panel 20 connecting the ends of the perforation 40 until the elevation member 44 is positioned under the bottom panel 20 as shown in FIG. 3.

Consequently, when the elevation member 44 is moved to its second position, illustrated in FIG. 3, the elevation member 44 elevates the second end 16 of the box 12 relative to its first end 14 so that the bottom panel 20 slopes downwardly from the second end 16 of the box 12 and to the first end 16 of the box 12. Consequently, any cans 33 contained within the interior of the box 12 move through the force of gravity towards the dispensing opening 24.

As best shown in FIG. 3, once the elevation member 44 is moved to its second position, an opening 48 is formed through the second end of the box 12. This opening 48, however, is smaller than the longitudinal sectional shape of the cans contained within the interior of the box 12. Consequently, such cans cannot pass through the opening 48.

From the foregoing, it can be seen that the present invention provides a simply and highly effective dispenser for cans which ensures that the cans automatically gravitate toward the first or dispensing end of the box 12. Having described my invention, however, any modifications thereto will become apparent to those of skill in art to which it pertains without deviation from the spirit of the invention as defined by the scope of the appended claims.

I claim:

1. A dispenser comprising:

an elongated box dimensioned to hold a plurality of cylindrical cans in a side by side relationship, said box having a top panel, bottom panel, first end panel, second end panel and two side panels, a dispensing opening in said first end panel dimensioned to allow single cans to be removed from said box, an elevation member at an end of said box opposite from said first end panel, said elevation member being selectively positionable under said bottom panel of said box, wherein said elevation member comprises portions of said box bottom panel, both said side panels and said second end panel, wherein said box includes perforations around and defining at least a portion of said elevation member.

2. The invention as defined in claim 1 wherein said portion of said bottom panel is hingedly secured to a remaining portion of said bottom panel.

* * * * *